US009803951B1

(12) United States Patent
Mashburn

(10) Patent No.: US 9,803,951 B1
(45) Date of Patent: Oct. 31, 2017

(54) BOYANCY DEVICE FOR A HUNTING BOW

(71) Applicant: Lesley Shane Mashburn, Joppa, AL (US)

(72) Inventor: Lesley Shane Mashburn, Joppa, AL (US)

( * ) Notice: Subject to any disclaimer, the term of this patent is extended or adjusted under 35 U.S.C. 154(b) by 0 days.

(21) Appl. No.: 15/342,755

(22) Filed: Nov. 3, 2016

(51) Int. Cl.
*F41B 5/14* (2006.01)
*B63B 22/12* (2006.01)
*B63B 22/22* (2006.01)

(52) U.S. Cl.
CPC ..... *F41B 5/148* (2013.01); *B63B 22/12* (2013.01); *B63B 22/22* (2013.01); *F41B 5/14* (2013.01)

(58) Field of Classification Search
CPC ..... B63B 22/12; B63B 22/14; B63B 22/22; F41B 5/00; F41B 5/14
See application file for complete search history.

(56) References Cited

U.S. PATENT DOCUMENTS 2,531,586 A * 11/1950 Ramsey ..... A01K 97/24 441/8
2,687,541 A * 8/1954 Bannister ..... B63C 7/10 114/54
3,210,785 A * 10/1965 Ward ..... A01K 97/24 441/9
4,295,438 A * 10/1981 Porter ..... G08B 5/002 116/210
4,578,041 A * 3/1986 Heitkamp, III ..... B63C 7/26 441/30
4,721,486 A * 1/1988 Goettel ..... B63C 7/26 251/294
5,156,562 A * 10/1992 Pearson ..... B63C 7/26 43/25
5,839,931 A * 11/1998 Shieh ..... B63B 22/22 441/30
7,540,796 B2 * 6/2009 Spears ..... B63B 22/08 441/8
9,650,112 B1 * 5/2017 Milam ..... B63B 22/08

* cited by examiner

*Primary Examiner* — John Ricci
(74) *Attorney, Agent, or Firm* — The Gache Law Firm, P.C; Russell C. Gache

(57) ABSTRACT

A float apparatus for preventing the loss of a bow accidentally dropped in a body of water, the apparatus including a hydrostatic valve, a camshaft, a plunger, a gas cartridge and a bladder, all of which are operatively coupled to one another by a valve frame contained within a housing. When a bow having the float apparatus attached thereto is submerged, the hydrostatic valve automatically rotates the camshaft when the float apparatus reaches a desired depth. As the camshaft rotates, it presses against the plunger causing it to pierce the gas cartridge thereby releasing a gas. The gas is then directed through the valve frame into the bladder thereby inflating the bladder and causing the bow to float.

23 Claims, 6 Drawing Sheets

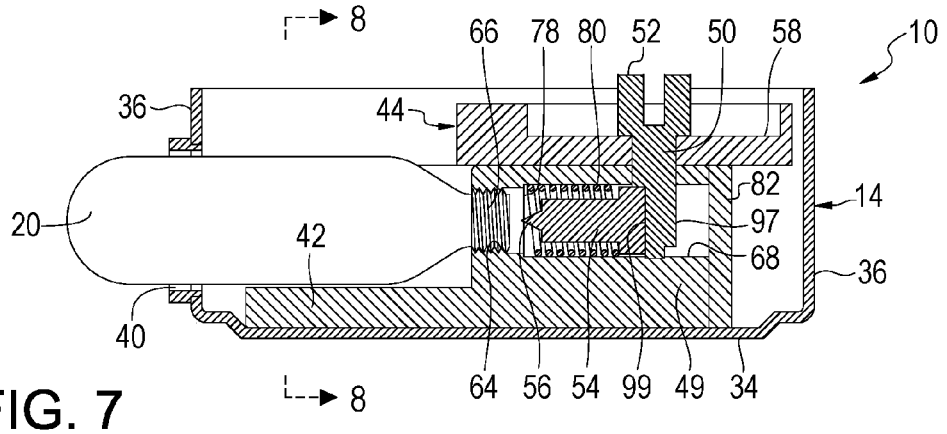
FIG. 7
FIG. 8
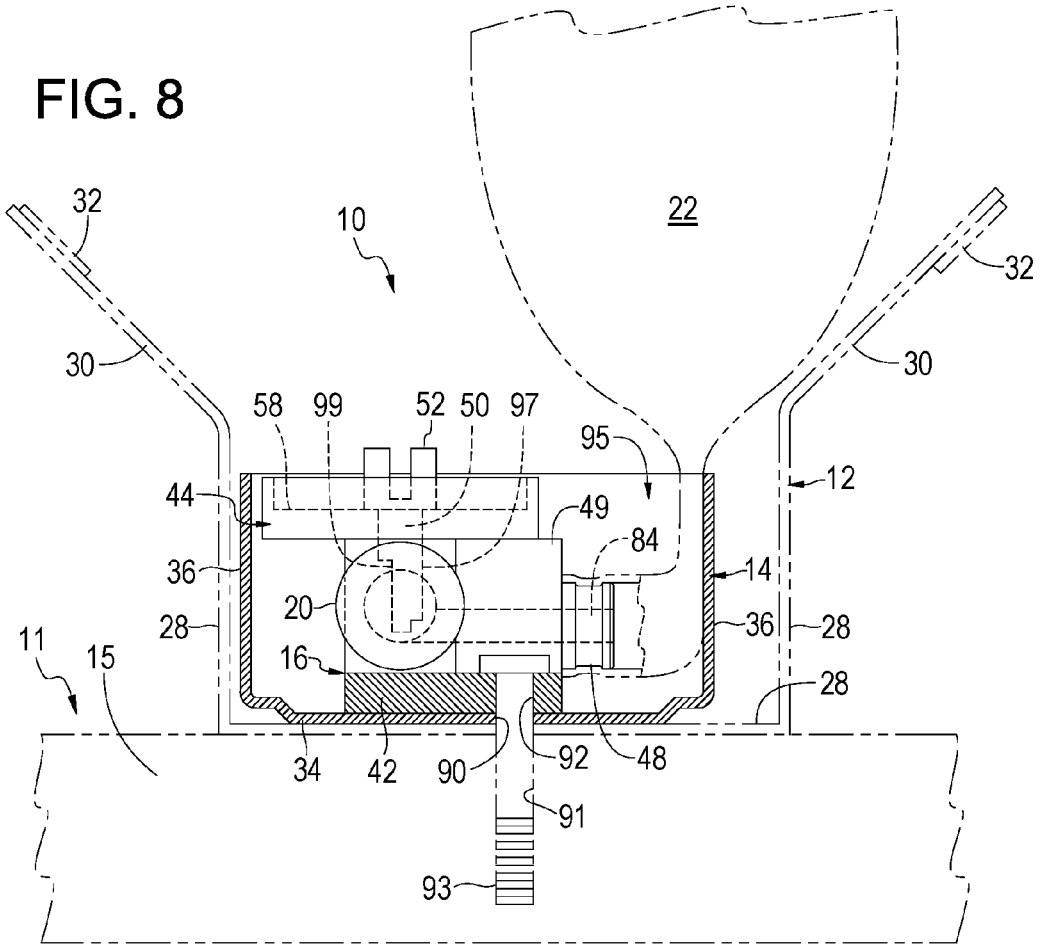

BOYANCY DEVICE FOR A HUNTING BOW

FIELD OF THE INVENTION

The present invention relates to an apparatus and method for preventing loss of a bow when bow fishing, and more particularly to a float apparatus configured for attaching to a bow and automatically deploying if the bow is dropped and submerged in water, for example, off the side of a boat or pier.

BACKGROUND OF THE INVENTION

One of the biggest fears in bow fishing is dropping a bow overboard. Modern fishing and hunting bows can cost more than one-thousand dollars. Because of the high cost of modern bows, many fishermen choose to use cheap and poor quality bows when bow fishing due to the fear of dropping a more expensive bow overboard. As such, there is a need in the industry for a means of retrieving a bow when dropped overboard into a body of water. Furthermore, since a bow can be dropped into a body water more than once during single session of fishing, such means must be easily re-armed and re-packed so that fishermen may return to fishing in minutes while continuing to be protected from losing the bow overboard.

SUMMARY OF THE INVENTION

The present invention is directed to a reusable float apparatus for use with a bow for preventing loss of the bow if dropped into a body of water. When a bow fitted with the float apparatus is submerged in at least four inches of water, the float apparatus automatically inflates a bladder which causes the bow to float towards the surface of the water thereby allowing a bow fisher to safely recover an overboard bow.

The float apparatus uses a hydrostatic valve to trigger deployment of the bladder. A hydrostatic valve is preferred over other water-activated valves, such as bobbin and "pill" valves which dissolve when contacted by water, since bow fishing is a very wet activity. The amount of water encountered by a bow during normal bow fishing would likely cause a bobbin or pin valve to trigger a premature deployment of the bladder. A suitable hydrostatic valve for use with the present invention is the Hammar® A1 automatic inflator available from CM Hammar AB, August Barks gata 15, SE-421 32 Västra Frölunda (Göteborg) Sweden. The Hammar® A1 automatic inflator includes a hydrostatic valve that when submerged in four inches (10 cm) of water, opens and allows the water to enter the inflator and contact a water sensitive element that in turn releases a stainless steel coil spring, which rotates a gear as the spring uncoils. When used with the present invention, rotation of the gear actuates a camshaft of the float apparatus that, in turn, actuates a plunger having a pointed tip. The plunger then punctures a 12 g carbon dioxide gas cartridge that is detachably threaded into the float apparatus.

The hydrostatic valve, camshaft, plunger, gas cartridge and bladder are operatively coupled to one another by a valve frame. The valve frame is a machined aluminum or injection molded plastic valve that houses the plunger and cam mechanism. The valve frame is otherwise void in the center thereof allowing for the gas from the gas cartridge to flow freely through the valve frame and into the inflatable bladder.

In use, the float apparatus is placed directly over bow's riser, and mounting holes in the valve frame are aligned with factory threaded holes in the riser. Using two 8/32 screws, the user threads the screws through the float apparatus and into the bow's riser. Once the float apparatus is securely fastened to the bow, the user inserts a threaded 12 g carbon dioxide gas cartridge into the valve frame and tightens it. This action secures the cartridge in place. The user then places the hydrostatic valve over the valve frame ensuring that the camshaft is aligned with the factory gears on the back of the hydrostatic valve. Once the gears are aligned, the hydrostatic valve is twisted while applying slight downward pressure. The factory locking lugs on the back of the hydrostatic valve are then received by the valve frame, locking them together. The deflated bladder is then rolled or folded and fitted it into an empty area inside of an enclosure housing the valve frame, hydrostatic valve and gas cartridge. In this configuration, the float apparatus is armed.

According to one aspect of the invention, the float apparatus includes a housing configured for attachment to a bow, the housing containing a hydrostatic valve, a camshaft operatively coupled to and actuated by the hydrostatic valve, a pointed plunger operatively coupled to and actuated by the camshaft, a gas cartridge operatively coupled to the plunger and a bladder operatively coupled to the gas cartridge. A valve frame is provided for supporting the components within the housing, the valve frame including a gas cartridge receiving portion having a gas inlet, a bladder receiving portion having a gas outlet and a gas passageway extending to and between the gas inlet and the gas outlet.

In use, the float apparatus is attached to a bow using bolts that attach to holes in the bow riser that are intended for coupling a bow sight to the bow. When the bow and float apparatus are dropped into a body of water, the hydrostatic valve automatically rotates the camshaft once the float apparatus reaches a desired depth. As it rotates, a cam portion on the camshaft presses a point portion of the plunger into the gas cartridge thereby releasing a compressed gas. The released gas is then directed through gas the passageway of the valve frame and into the bladder, thereby inflating the bladder and causing the bow to float. Once the bow floats to the surface of the body of water, it can be retrieved.

According to another aspect of the invention, there is provided a float apparatus including a valve frame configured for attachment to a bow, the valve frame including a hydrostatic valve receiving portion, a gas cartridge receiving portion having a gas inlet, a camshaft receiving portion, a plunger receiving portion, a bladder receiving portion having a gas outlet and a gas passageway extending to and between the gas inlet and the gas outlet. The hydrostatic valve receiving portion and camshaft receiving portion are arranged so that a hydrostatic valve and a camshaft supported by the valve frame operate to rotate the camshaft when the hydrostatic valve is submerged to a desired depth within a body of water. The plunger receiving portion is arranged so that upon rotation of the camshaft, a plunger slides within the plunger receiving portion towards and into a detachable gas cartridge supported within the gas cartridge receiving portion. When the gas cartridge is punctured, a gas such as carbon dioxide is released which travels through the inlet, gas passageway and outlet into a bladder supported by the bladder receiving portion.

According to yet another aspect of the invention there is provided a bow including a source of gas, an inflatable bladder and a mechanism configured for both selectively releasing a gas from the source of gas when the bow is submerged in a liquid and directing the gas into the inflatable bladder. The mechanism includes a valve frame having a gas passageway extending between the source of gas and the inflatable bladder, a gas cartridge receiving portion having an inlet and a nozzle having an outlet, the inlet and the outlet defining respective ends of the gas passageway. The mechanism also includes a hydrostatic valve and a plunger, the plunger being selectively actuated by the hydrostatic valve to pierce the source of gas for release of the gas into the inflatable bladder.

In use, when the bow is submerged in a body of water, the gas is released from the source of gas once the bow is at or below a desired depth in the body of water. The released gas is directed through the gas passageway and into the inflatable bladder thereby inflating the inflatable bladder and causing the bow to float upward.

Other features and objects and advantages of the present invention will become apparent from a reading of the following description as well as a study of the appended drawings.

BRIEF DESCRIPTION OF THE DRAWINGS

A buoyancy device for a hunting bow incorporating the features of the invention is depicted in the attached drawings which form a portion of the disclosure and wherein:

FIG. 7 is a sectional view of the bow float of FIG. 5 along line 7-7; and, FIG. 8 is a sectional view of the bow float of FIG. 7 along line 8-8 with the bladder in an inflated state.

DESCRIPTION OF THE PREFERRED EMBODIMENTS

Figure 1:
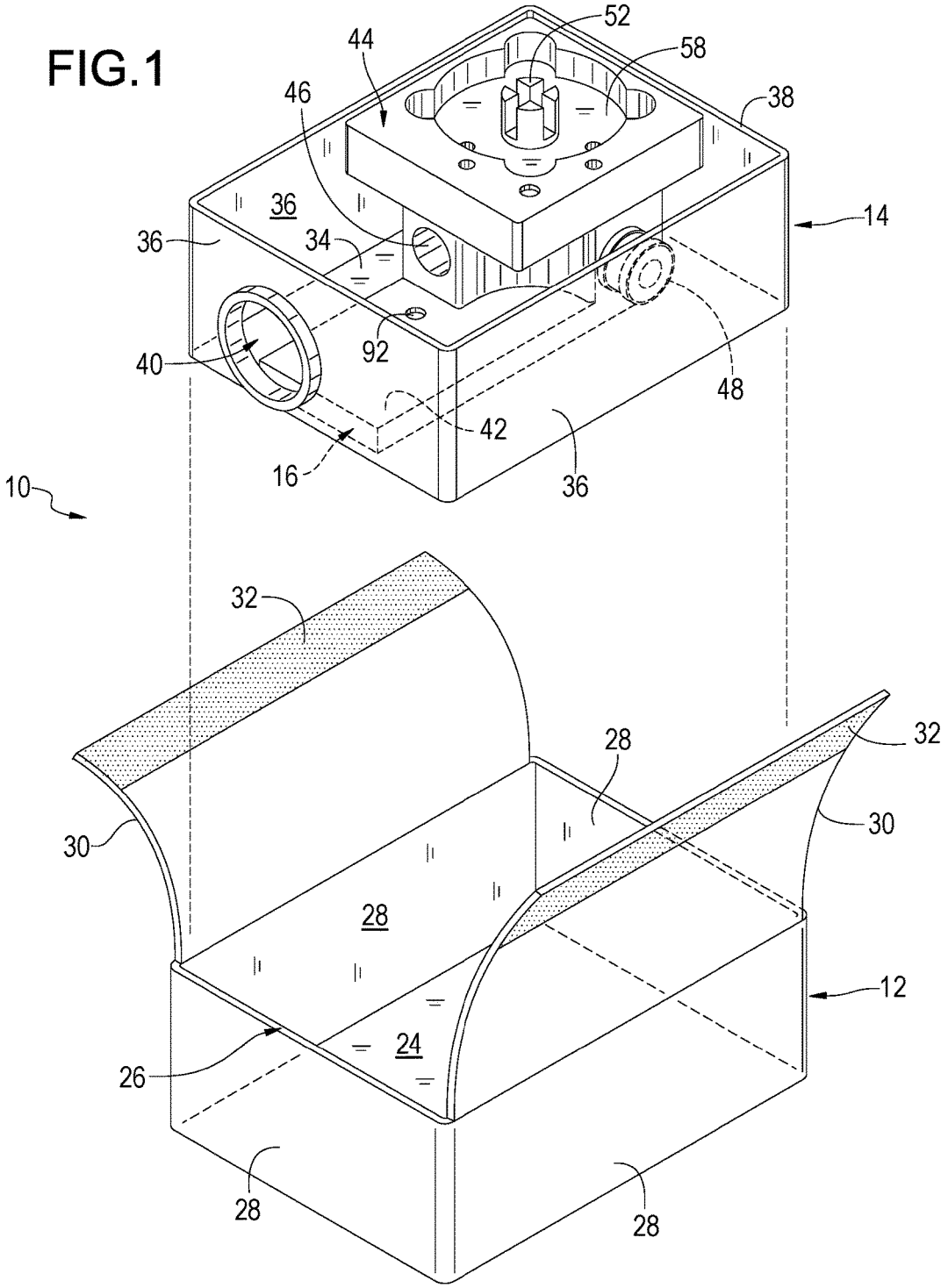
FIG. 1 is a perspective view of a valve frame, inner housing and outer housing of a bow float in accordance with the present invention.

Referring to the drawings for a better understanding of the function and structure of the invention FIGS. 1 through 8 depict a bow float 10 in accordance with a preferred embodiment of the present invention. Referring to FIGS. 1 through 4, bow float 10 generally includes a fabric outer enclosure 12, a rigid inner housing 14 and a valve frame 16 for operatively coupling together a hydrostatic valve member 18, a gas cartridge 20 and an inflatable bladder 22 in a manner allowing for selective inflation of bladder 22. In use, bow float 10 is attached to a bow 11, such as a compound bow, for the purpose of preventing sinking and allowing retrieval of bow 11 should it be dropped in a body of water.

More particularly, referring to FIG. 1, outer enclosure 12 is manufactured from Cordura® nylon, which is available from Invista, a wholly owned subsidiary of Koch Industries. Outer enclosure 12 is rectangular having a floor 24, an open top 26, continuous sidewalls 28 extending between the open top and the floor and a pair of flaps 30 pivotally coupled to opposing edges of open top 26. Hook and pile fasteners 32 are adhered to pair of flaps 30 for releasably securing the flaps to one another. Outer enclosure 12 is selectively closed by pressing fasteners 32 together.

Located within outer enclosure 16 is inner housing 14. Inner housing 14 may be manufactured from any suitable rigid material such as metal or plastic. Inner housing 14 includes a rectangular lower wall 34, a continuous sidewall 36 extending upwardly from the periphery of lower wall 34 and an open top 38 defined by continuous sidewall 36. Extending through continuous sidewall 36 is a hole 40 arranged for receiving gas cartridge 20 so that the cartridge may be loaded into valve frame 16. When placed within outer enclosure 12, sidewalls 36 of inner housing 14 are located directly against sidewalls 28 of outer enclosure 12 with the exception of that portion of sidewall 36 of inner housing 14 through which hole 40 extends. That portion of sidewall 36 is spaced apart from sidewall 28 of outer enclosure 28 so that a small gap is provided which provides space for gas cartridge 20 to protrude out through hole 40 into the interior of outer enclosure 12.

Figure 2:
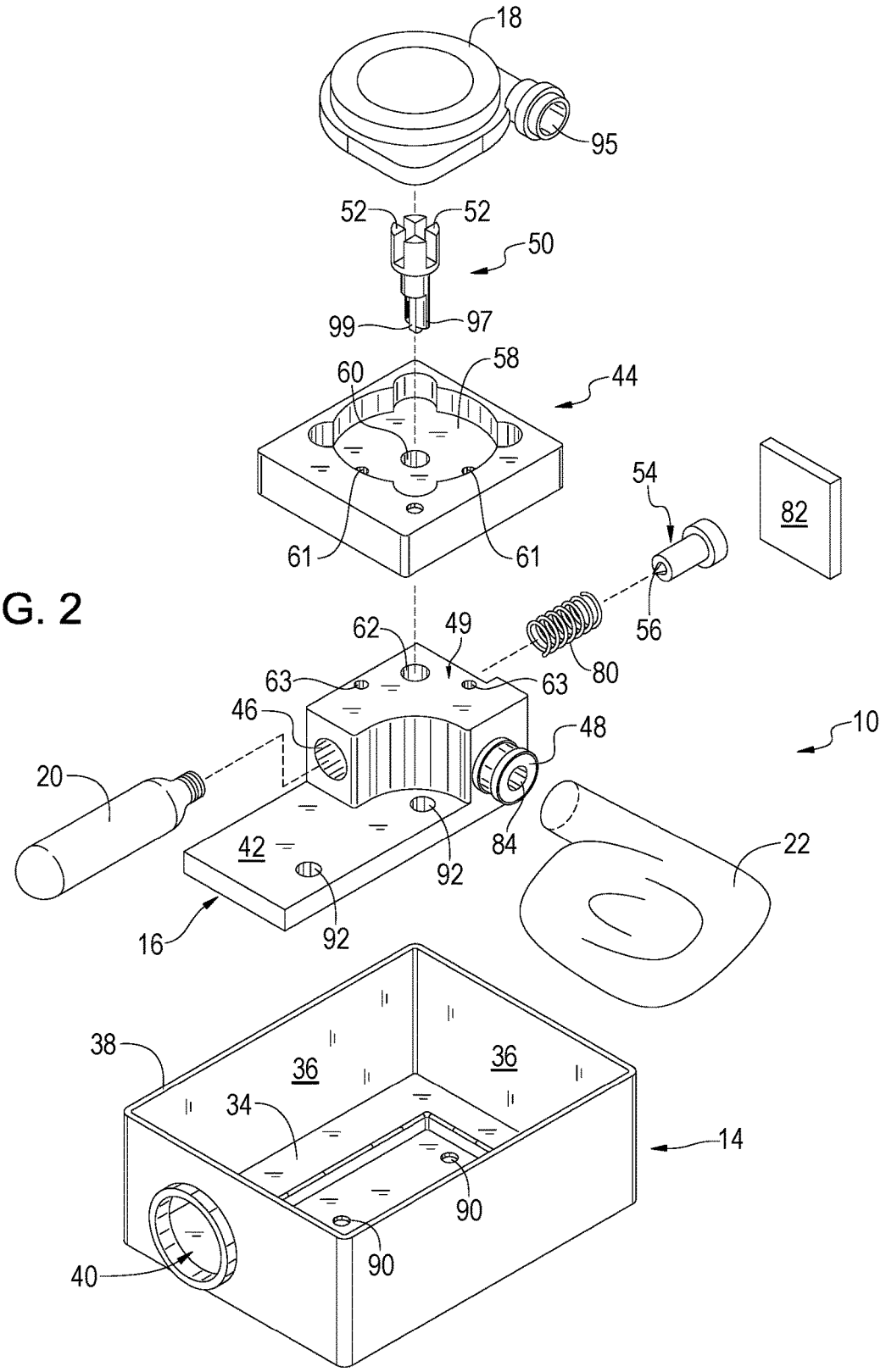
FIG. 2 is an exploded perspective view of the bow float of FIG. 1 illustrating the arrangement of a hydrostatic valve, a gas cartridge and an inflatable bladder relative to the valve frame.

Referring to FIGS. 1 and 2, located within inner housing 14 is valve frame 16. Valve frame 16 includes a rectangular base 42, a hydrostatic valve receiving portion 44, a gas cartridge receiving portion 46 and a nozzle 48. Gas cartridge receiving portion 46 and nozzle 48 are fluidly coupled to one another and are an integral part of a hollow, valve frame body 49, which defines passageways connecting the Gas cartridge receiving portion 46 and nozzle 48.

The configuration of hydrostatic valve receiving portion 44 is dependent on the arrangement of hydrostatic valve member 18. In the current embodiment, hydrostatic valve member 18 is a Hammar® A1 automatic inflator, which incorporates a water sensitive element that, when contacted by water, releases a stainless steel coil spring, which rotates a gear (not shown) of hydrostatic valve member 18 as the spring uncoils. Rotation of the gear actuates a camshaft 50 having teeth 52 that are complimentary with the gears of hydrostatic valve member 18 which, in turn, actuates a plunger 54 having a pointed tip 56. In view of the use of the Hammar® A1 automatic inflator, hydrostatic valve receiving portion 44 includes a depression 58 shaped to receive hydrostatic valve member 18. Once the gears are aligned, hydrostatic valve member 18 is twisted while applying slight downward pressure. The factory locking lugs on the back of hydrostatic valve 18 are then received within depression 58 of hydrostatic valve receiving portion 44, locking them together.

Hydrostatic valve receiving portion 44 includes a central opening 60 for receiving camshaft 50. When hydrostatic valve receiving portion 44 is coupled to valve frame body 49, opening 60 is aligned with a camshaft receiving portion 62 in the valve frame body and a pair of fasteners (not shown) is inserted into fastening holes 61, which extend through depression 58, and into complimentary fastening holes 63 in valve frame body 49 thereby fixing hydrostatic receiving portion 44 to valve frame body 49. Prior to securing hydrostatic valve member 18 to hydrostatic vale member receiving portion 44, cam shaft 50 is inserted through opening 60 of depression 58 and 62 of valve frame body 49, respectively.

Figure 6:
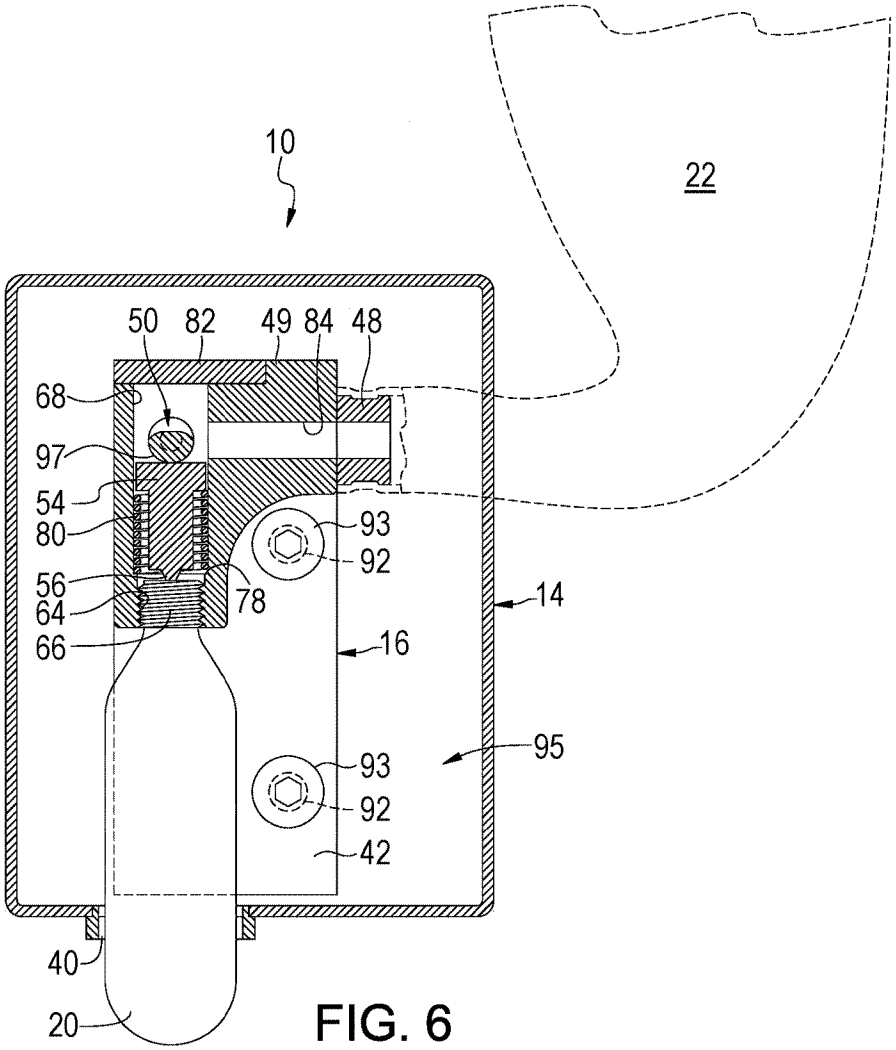
FIG. 6 is a sectional view of the bow float of FIG. 2 in a deployed state.
Figure 5:
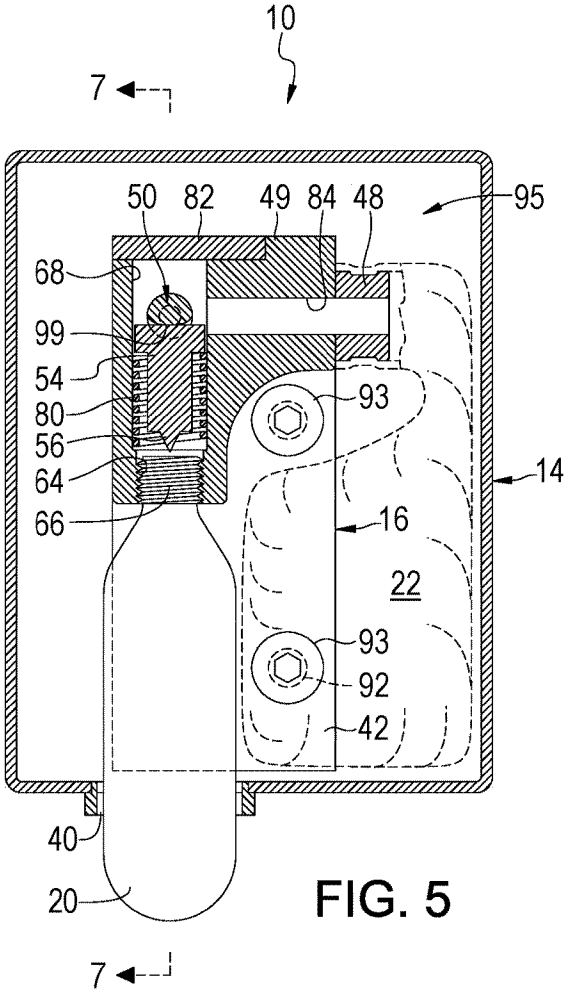
FIG. 5 is a sectional view of the bow float of FIG. 2 in an un-deployed state.

Referring to FIGS. 5-7, gas cartridge receiving portion 46 includes a female threaded passageway 64 that is arranged for receiving a male threaded end 66 of gas cartridge 20 and directing a gas released from the gas cartridge to nozzle 48. Female threaded passageway 64 opens into a plunger receiving passageway 68, which contains plunger 54. Plunger 54 is biased against a spring seat 78 within plunger receiving passageway 68 by a spring 80 which forces plunger 54 away from gas cartridge 20 and gas cartridge receiving portion. Movement of plunger 54 away from gas cartridge 20, by virtue of spring 80 pressing against plunger 54, is limited by a lower end of camshaft 50 which extends into plunger receiving passageway 68 from opening 62 of valve frame body 49. A detachable door 82 provides access into plunger receiving passageway 68 for allowing placement of spring 80 and plunger 54 into plunger receiving passageway 68, prior to insertion of camshaft 50 through opening 60 and into opening 62.

Extending at a right angle from and being fluidly coupled to plunger receiving passageway 68 is nozzle passageway 84. Nozzle passageway 84 extends through nozzle 48 and provides a pathway by which gas released from gas cartridge 20 can exit into bladder 22 thereby inflating the bladder.

Figure 3:
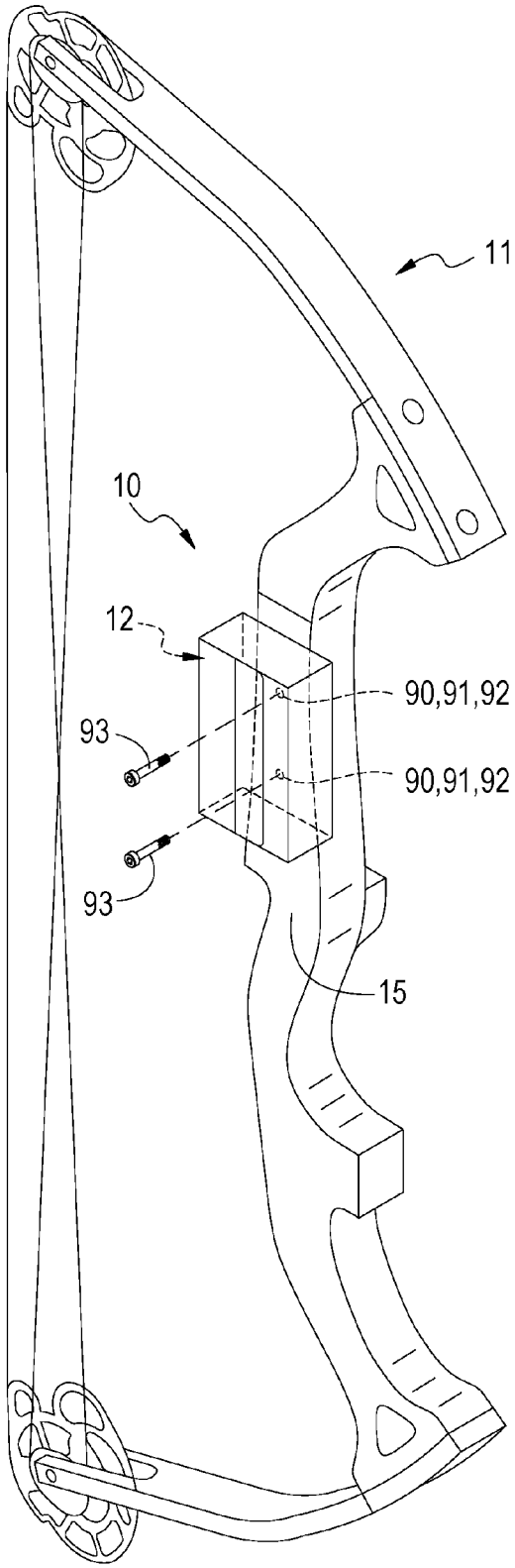
FIG. 3 is a perspective view of the bow fitted with the bow float of FIG. 2.

As shown in FIG. 3, in use inner housing 14 is placed within outer enclosure 12 with valve frame 16 disposed within inner housing 14. The assembly is then placed directly over the riser 15 of bow 11 with mounting holes 90 within lower wall 34 of inner housing 14 being aligned with the factory threaded holes 91 in the riser 15. Using two 8/32 screws 93, the screws are inserted through mounting holes 92 (see FIG. 2) in rectangular base 42 of valve frame 16, holes 90 through lower wall 34 of inner housing 14 and into the factory threaded holes 91 in the bow's riser 15 as shown.

Referring again to FIGS. 5-7, once bow float 10 is securely fastened to bow 11 gas cartridge 20 is inserted through hole 40 in inner housing 14 and into gas cartridge receiving portion 46 where male threaded end 66 of gas cartridge 20 is threaded into female threaded passageway 64 and tightened thereby securing gas cartridge 20 in place. Since outer enclosure 12 is made of fabric, it can easily be manipulated to expose and provide access into hole 40.

With gas cartridge 20 secured to valve frame 16, hydrostatic valve member 18 is positioned over hydrostatic valve receiving portion 44 with the hydrostatic valve member gears (not shown) being operatively aligned with teeth 52 of camshaft 50. Once the gears are aligned, hydrostatic valve member 18 is twisted while applying slight downward pressure. Factory locking lugs on the back of hydrostatic valve member 18 are then received within depression 58 of hydrostatic valve member receiving portion, locking them together. Bladder 22, in a deflated state, is then rolled or folded and fitted into an empty area 95 inside of inner housing 14. Flaps 30 of outer enclosure 12 are then pressed together with hook and pile fasters 32 holding flaps 30 together in a closed manner. In this configuration, bow float 10 is armed.

Figure 4:
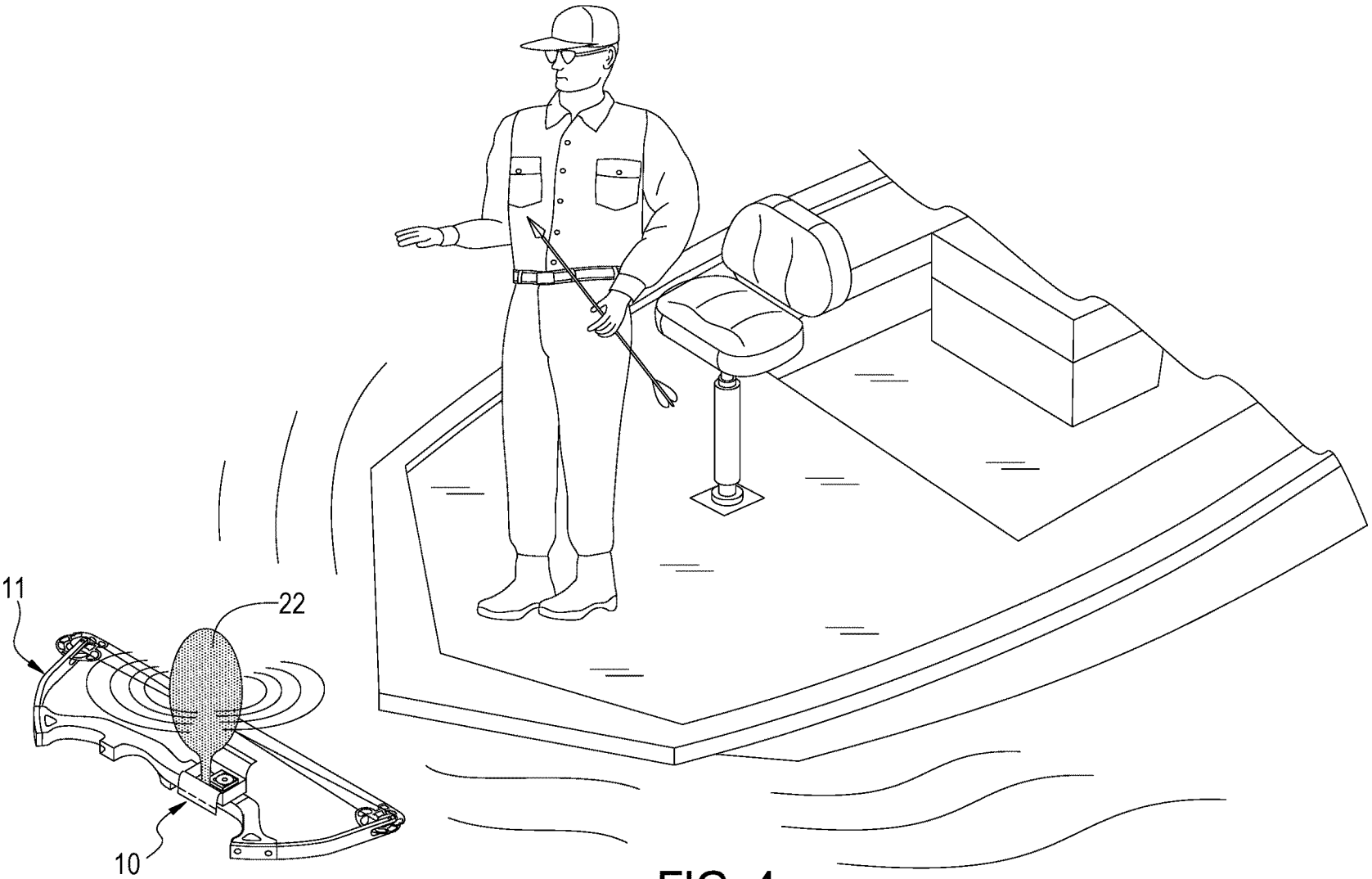
FIG. 4 is a perspective view of the bow float of FIG. 3 floating in a body of water and illustrating the inflatable bladder in an inflated or deployed state.

Referring to FIG. 4 in conjunction with FIGS. 5-7, when bow 11 with bow float 10 attached thereto are dropped into a body of water, bladder 22 inflates causing bow 11 to float to the surface of the body of water. Inflation of bladder 22 is triggered by hydrostatic valve member 18 when sufficient pressure is imparted onto a hydrostatic valve (not shown) within hydrostatic valve member 18 by water entering into an entryway 95 of member 18. Upon reaching a predetermined pressure, which occurs when hydrostatic valve member 18 is submerged to a depth of at least four inches, the hydrostatic valve opens allowing water to pass to the water sensitive element that, when contacted by the water, releases the stainless steel coil spring, which rotates the gear of hydrostatic valve member 18 as the spring uncoils. Rotation of the gear causes camshaft 50 to rotate within plunger receiving passageway 68. As camshaft 54 rotates, a flat surface 99 of camshaft 50 slidingly rotates across the head of plunger 54 and is replaced by a cam portion 97 of the cam shaft, which forces plunger 54 towards gas cartridge 20. When the pointed tip plunger 54 punctures gas cartridge 20, the released gas exits into plunger receiving passageway 68 and is forced into nozzle passageway 84 and ultimately bladder 22 thereby inflating the bladder. As bladder 22 inflates, it presses against flaps 30 until sufficient pressure is exerted onto the flap to overcome hook and pile fasteners 32, at which time the flaps are forced open to allow bladder 22 to continue inflating thereby causing the bow to float to the surface where it can be retrieved. As further shown in FIG. 8, apparatus 10 is affixed to a bow 11 with bladder 22 in an inflated state that will force the combination of the bow 11 and the apparatus 10 to the water surface thereby allowing the bow owner to easily retrieve the bow 11.

While I have shown my invention in one form, it will be obvious to those skilled in the art that it is not so limited but is susceptible of various changes and modifications without departing from the spirit thereof.

Having set forth the nature of the invention, what is claimed is:

1. A float apparatus, comprising:

a housing configured for attachment to a bow, the housing containing a hydrostatic valve member, a camshaft operatively coupled to the hydrostatic valve, a plunger operatively coupled to the camshaft, a gas cartridge operatively coupled to the plunger, and a bladder operatively coupled to the gas cartridge.

2. The apparatus of claim 1, wherein the housing includes a flap having an open orientation that allows the bladder to inflate and protrude out of the housing and a closed orientation.

3. The apparatus of claim 2, wherein the closed orientation is maintained with a hook and loop fastener system.

4. The apparatus of claim 1 wherein the housing is coupled to a compound bow.

5. The apparatus of claim 1 including a valve frame, the valve frame including a gas cartridge receiving portion having a gas inlet, a bladder receiving portion having a gas outlet and a gas passageway extending to and between the gas inlet and the gas outlet.

6. The apparatus of claim 1 wherein the hydrostatic valve member is configured for rotating the camshaft when the hydrostatic valve member is submerged in a liquid.

7. The apparatus of claim 6 wherein the camshaft is configured for pressing the plunger into the gas cartridge thereby piercing the gas cartridge.

8. A method of retrieving a bow dropped in a body of water comprising:

a. attaching the float apparatus of claim 1 to the bow;

b. dropping the bow with the float apparatus attached thereto into the body of water;

c. using the hydrostatic valve member to automatically rotate the camshaft when the float apparatus is submerged at or below a desired depth;

d. using the camshaft to press the plunger into the gas cartridge thereby releasing a gas;

e. directing the gas into the bladder and thereby inflating the bladder and causing the bow to float; and, f. retrieving the bow from the body of water when the bow surfaces from the body of water.

9. A float apparatus comprising:

a. a valve frame configured for attachment to a bow, the valve frame including;

b. a camshaft receiving portion;

c. a hydrostatic valve receiving member portion connected to said camshaft receiving portion;

d. a gas cartridge receiving portion having a gas inlet;

e. a bladder receiving portion having a gas outlet; and, f. a gas passageway extending to and between the gas inlet and the gas outlet.

10. The apparatus of claim 9, wherein the valve frame includes a plunger receiving portion.

11. The apparatus of claim 10, including a camshaft received within the camshaft receiving portion, a plunger received within the plunger receiving portion and a hydrostatic valve member received within the hydrostatic valve member receiving portion, wherein the camshaft is operatively coupled to and between the hydrostatic valve member and the plunger.

12. The apparatus of claim 9, including a gas cartridge detachably coupled to the gas cartridge receiving portion and an inflatable bladder coupled to the bladder receiving portion.

13. The apparatus of claim 9, wherein the valve frame is located within a housing that is secured to a compound bow.

14. A bow comprising:

a. a source of gas;

b. an inflatable bladder; and, c. a mechanism configured for selectively releasing a gas from the source of gas when the bow is submerged in a liquid and directing the gas into the inflatable bladder, said releasing mechanism including a hydrostatic valve and a camshaft within a housing for triggering said mechanism.

15. The bow of claim 14, wherein the mechanism includes a valve frame having a gas passageway extending between the source of gas and the inflatable bladder.

16. The bow of claim 15, wherein the valve frame includes a gas cartridge receiving portion having an inlet and a nozzle having an outlet, the inlet and the outlet defining respective ends of the gas passageway.

17. The bow of claim 14, wherein the mechanism includes a plunger, the plunger being selectively actuated by the hydrostatic valve to pierce the source of gas for release of the gas into the inflatable bladder.

18. The bow of claim 14, including a housing containing the source of gas, the inflatable bladder and the mechanism.

19. A method of retrieving a bow from a body of water comprising:

a. submerging the bow in a body of water;

b. triggering a release mechanism with a hydrostatic valve connected to a camshaft;

c. responsive to movement of said camshaft, releasing gas from a source of gas attached to the bow when the bow is at or below a desired depth in the body of water;

d. directing the gas into the inflatable bladder thereby inflating the inflatable bladder and causing the bow to float upward; and, e. retrieving the bow after the bow surfaces the body of water.

20. A bow flotation device, comprising:

a. housing means for attaching said flotation device to a bow b. means within said housing means for providing a hydrostatic valve, wherein said valve means includes a camshaft for rotation thereof responsive to actuation of said valve means;

c. plunger means operatively coupled to said camshaft;

d. means operatively coupled to said plunger for providing a gas source; and e. means for providing an inflatable bag operatively coupled to said gas means, wherein said bag means is configured to inflate from an empty state into an inflated state upon actuation of said gas means.

21. A flotation device as recited in claim 20, wherein said housing means is adapted to for affixation to a riser portion of said bow.

22. A flotation device as recited in claim 21, further including means for enclosing said housing in a flexible container, wherein said enclosing means is adapted to allow access to said gas means for insertion or removal thereof.

23. A flotation device as recited in claim 22, wherein said enclosing means comprises fabric.

* * * * *